US006379021B1

(12) United States Patent
Shieh

(10) Patent No.: US 6,379,021 B1
(45) Date of Patent: Apr. 30, 2002

(54) SPIRAL DECORATIVE LIGHT TREE

(76) Inventor: Whiter Shieh, 6F, No. 245, Tun Hua South Road, Sec. 1, Taipei, 106 (TW)

( * ) Notice: Subject to any disclaimer, the term of this patent is extended or adjusted under 35 U.S.C. 154(b) by 0 days.

(21) Appl. No.: 09/507,894

(22) Filed: Feb. 22, 2000

(51) Int. Cl.[7] ..... A47G 33/06

(52) U.S. Cl. ..... 362/123; 362/362; 362/235; 362/245; 362/551; 362/806; 362/219

(58) Field of Search ..... 362/362, 123, 362/235, 249, 252, 806, 219, 551, 385

(56) References Cited

U.S. PATENT DOCUMENTS 5,359,502 A * 10/1994 Cantin ..... 362/123
5,413,825 A * 5/1995 Chaikin ..... 362/123
5,438,840 A * 8/1995 Reum et al. ..... 362/249
6,027,228 A * 2/2000 Adams et al. ..... 362/252
6,039,458 A * 3/2000 Coates, Jr. et al. ..... 362/249
6,048,590 A * 4/2000 Phillips ..... 362/123
6,132,063 A * 10/2000 Byers ..... 362/252
6,139,168 A * 10/2000 Gary et al. ..... 362/252
6,272,584 B1 * 8/2001 Wang et al. ..... 362/123

* cited by examiner

*Primary Examiner*—Sandra O'Shea
*Assistant Examiner*—Anabel Ton
(74) *Attorney, Agent, or Firm*—Troxell Law Office PLLC

(57) ABSTRACT

A decorative light tree with an elongate pipe retained in a three-dimensional spiral shape is disclosed. One end of the elongate pipe is supported on a top end of a central post, and the other end is spirally suspended around the central post. A number of ropes extend at a predetermined angle with respect to the central post and angularly spaced from each other about the central post, binding on the pipe thereby securely retaining the pipe in a three-dimensional spiral shape. A plurality of lightening members are electrically connected in series and arranged inside the hollow inner tube of the elongate pipe in a manner equally spaced from each other. Further, a number of clips clip on the pipe and then the ropes binding on the clips. Each of the ropes has a downward extended section for being fixed in a location by a fixing member.

16 Claims, 6 Drawing Sheets

SPIRAL DECORATIVE LIGHT TREE

BACKGROUND OF THE INVENTION

1. Field of the Invention

The present invention generally relates to a decorative light tree and in particular to a decorative light tree with a three-dimensional spiral shape. The decorative light tree mainly comprises a supporting frame and an elongate pipe supported thereon, incorporating with a number of ropes to form a three-dimensional spiral light tree that is easily assembling.

2. Description of the Prior Art

Decorative light strings are widely used in holidays and festivals, especially in Christmas. A light string usually is composed of a plurality of bulb sockets and an electrical wire for connecting the bulb sockets. Each of the bulb sockets may receive and hold a light bulb thereon. Typically, the light bulbs arranged on the light string are electrically connected in series to form a series circuit loop. An electric plug may be provided at one end of the light string for connection with an external power source. Further, an electric socket may be connected at the other end of the light string to provide an electrical connection to another light string to form an extendible long light string.

Conventionally, the light string is arranged on a tree directly and randomly for decorating purpose. The light string may be tangled on the tree easily and taking off the light string from the tree becomes a terrible task. The light string that has been taken off often tangles together and becomes a chaotic mass, and the sockets or bulbs will easily drop out at this time. It is really a trouble to arrange the light string into a box for storing.

Thus, it is desired to have an improved decorative light tree that can be easily assembled and stored for overcoming the problems discussed above.

SUMMARY OF THE INVENTION

Accordingly, a primary object of the present invention is to provide a decorative light tree with three-dimensional spiral construction.

Another object of the present invention is to provide a spiral decorative light tree easy to be assembled and stored.

One more object of the present invention is to provide a decorative light tree including a light string mounted in an elongate pipe and supported by a supporting frame so as to retain the decorative light tree in a three-dimensional spiral shape.

To achieve the above objects, in accordance with the present invention, there is provided a spiral decorative light comprising a supporting frame having an upright central post mounted on a stand. A support ring is attached to a section near the top end of the central post for an elongate pipe attached thereon. A star-shape member is attached to the top end of the central post for the star-shape surround section of the elongate pipe may be attached thereon. The elongate pipe is transparent and with a hollow inner tube formed therein. A plurality of lighting members electrically connected in series and arranged inside the hollow inner tube of the elongate pipe in a manner equally spaced from each other. When spreading the elongate pipe to arrange on the supporting frame, the first end of the elongate pipe is supported on the supporting ring and the free second end is spirally suspended around the central post. A number of ropes extend at a predetermined angle with respect to the central post and angularly spaced from each other about the central post, binding on the pipe thereby securely retaining the pipe in a three-dimensional spiral shape. Further, a number of clips clip on the pipe and then the ropes binding on the clips. Each of the ropes has a downward extended section for being fixed in a location by a fixing member.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENTS

Figure 1:
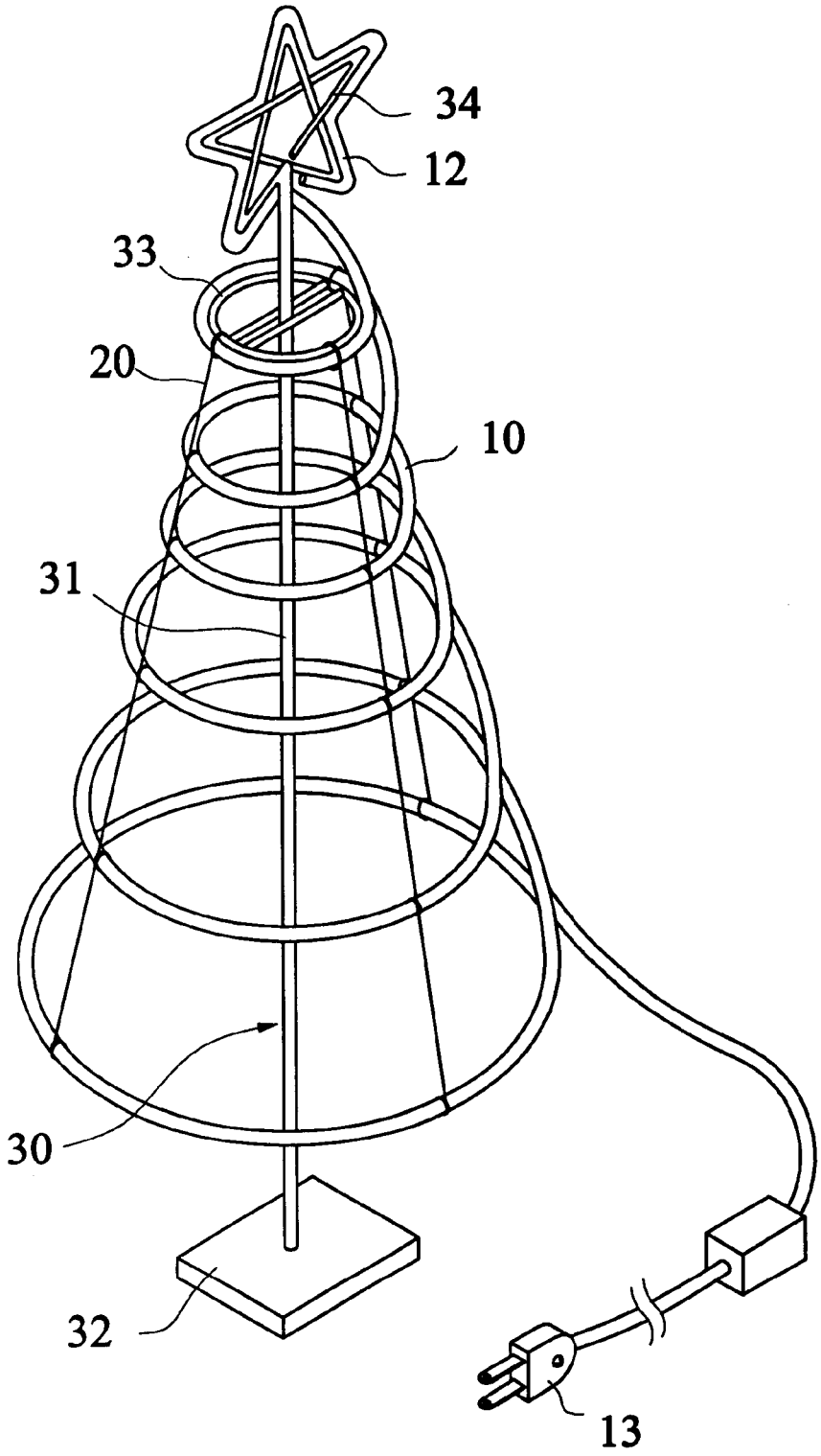
FIG. 1 is a perspective view of a spiral decorative light tree constructed in accordance with a first embodiment of the present invention.
Figure 2:
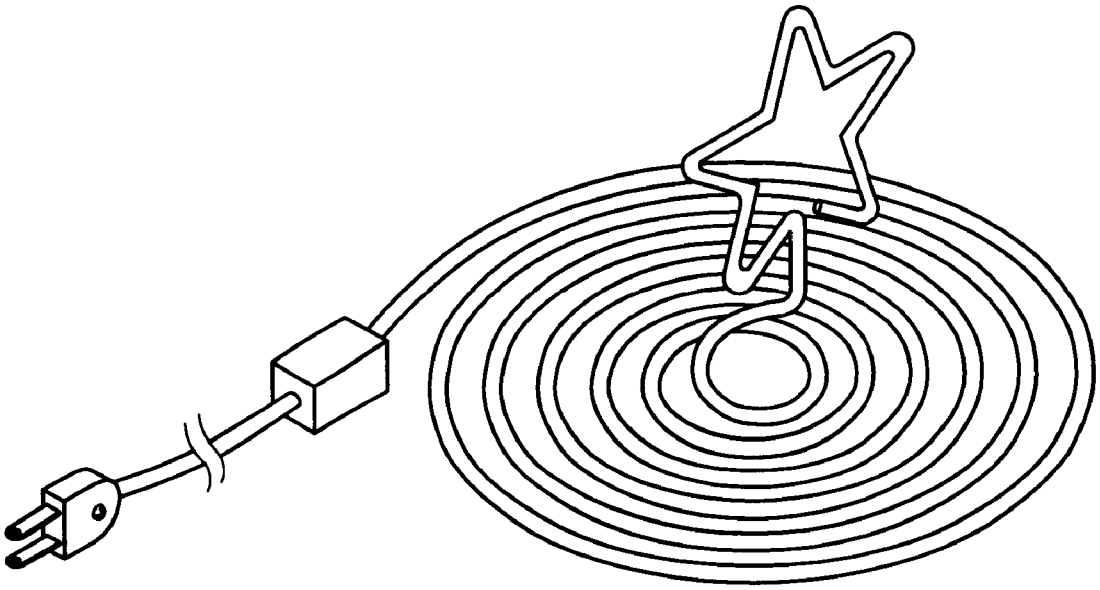
FIG. 2 is a schematic view of a spiral decorative light tree showing the elongate pipe forming a plane spiral in accordance with a first embodiment of the present invention.

With reference to the drawings and in particular to FIG. 1 and FIG. 2, a spiral decorative light tree constructed in accordance with a first embodiment of the present invention, comprises an elongate pipe 10, a plurality of ropes 20, and a supporting frame 30.

The elongate pipe 10 is preferably made of soft and transparent material, such as rubber, with a hollow inner tube formed therein. A plurality of lighting members 11 are electrically connected in series and arranged inside the hollow inner tube of the elongate pipe 10 in a manner equally spaced from each other. A plug 13 is connected to the elongate pipe 10 for supplying electric power thereto. The series connected lighting members 11 may be constructed by small bulbs or LED lamps, and one of the bulbs may be a known flashing control bulb for controlling the flashing effects of the series connected lighting members 11. A star-shape surround section 12 is formed on a first end of the elongate pipe 10 and a free second end of the elongate pipe 10 coils sequentially to form a plane spiral shape, as shown in FIG. 2

The supporting frame 30 comprises an upright central post 31 mounted on a stand 32. A supporting ring 33 is attached to a section near the top end of the central post 31 for the elongate pipe 10 being supported thereon. A star-shape member 34 is attached to the top end of the central post 31 for the star-shape surround section 12 of the elongate pipe 10 being attached thereon.

Referring to FIG. 1, when spreading the elongate pipe 10 to arrange on the supporting frame 30, the first end of the elongate pipe 10 is supported on the supporting ring 33 and the free second end is spirally suspended around the central post 31. The ropes 20 extend at a predetermined angle with respect to the central post 31 and angularly spaced from each other about the central post 31, binding on the elongate pipe 10 thereby securely retaining the elongate pipe 10 in a three-dimensional spiral shape.

A color material (not shown) may be covered on the elongate pipe 10 separately, such as spreading transparent color paint or pasting transparent color paper on the elongate pipe 10. The series connected lighting members 11 locates separately in the location with color material or without color material to make the spiral decorative light be more colorful.

Figure 3:
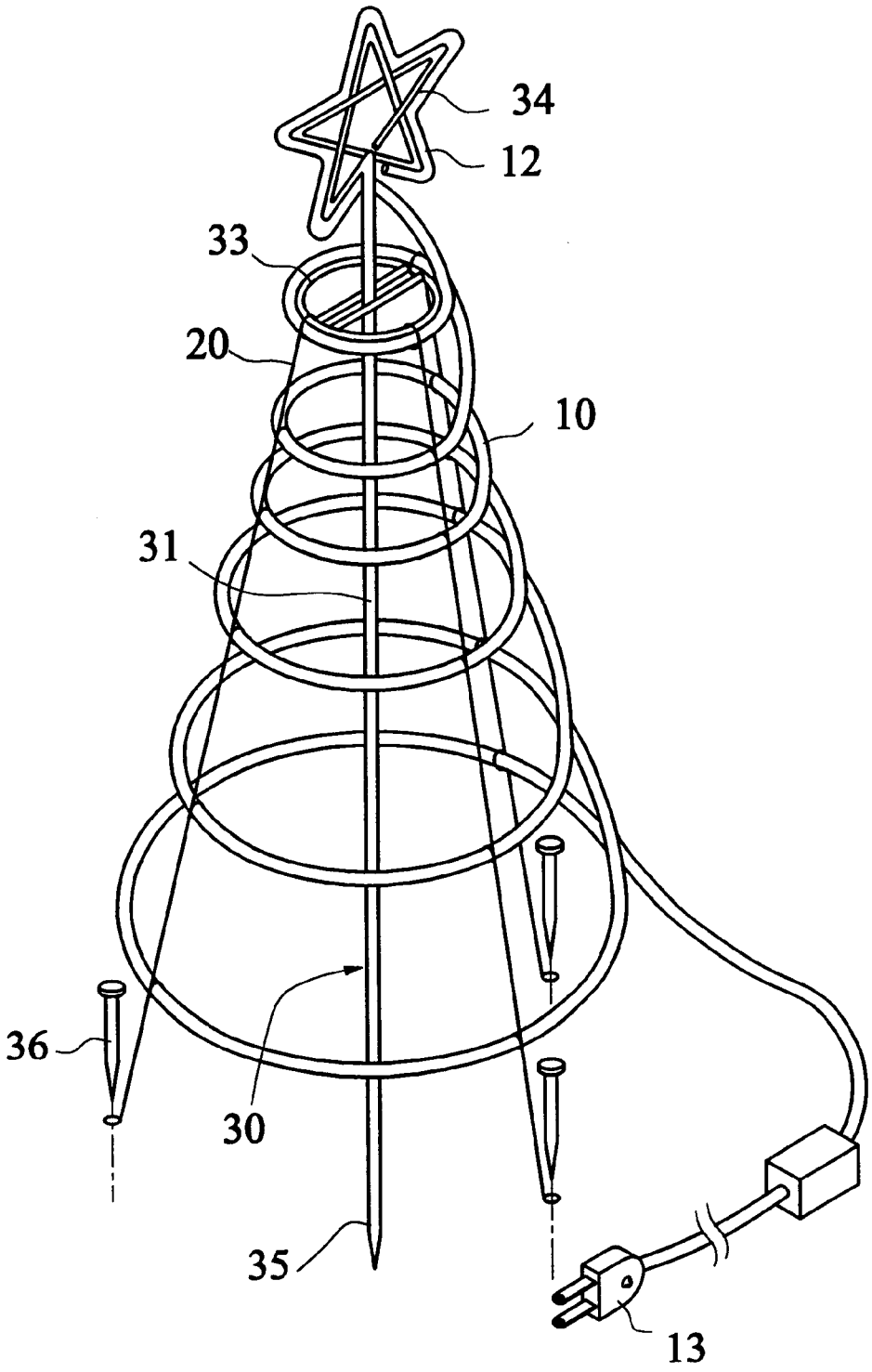
FIG. 3 is a perspective view of a spiral decorative light tree constructed in accordance with a second embodiment of the present invention.

FIG. 3 shows a spiral decorative light tree constructed in accordance with a second embodiment of the present invention. The supporting frame 30 comprises an upright central post 31 having a tapering lower end 35 for facilitating piercing into the ground when the spiral decorative light tree is used outdoor. When spreading the elongate pipe 10 to arrange on the supporting frame 30, the first end of the elongate pipe 10 is supported on the supporting ring 33 and the free second end is spirally suspended around the central post 31. The star-shape surround section 12 of the elongate pipe 10 is mounted on the star-shape member 34 attached on the top end of the central post. The ropes 20 extend at a predetermined angle with respect to the central post 31 and angularly spaced from each other about the central post 31, binding on the elongate pipe 10 thereby securely retaining the elongate pipe 10 in a three-dimensional spiral shape. Each of the ropes 20 has a downward extended section for being fixed in a location by a fixing member 36. The fixing members 36 may use iron nails, tent nails, or other equal function members.

Figure 4:
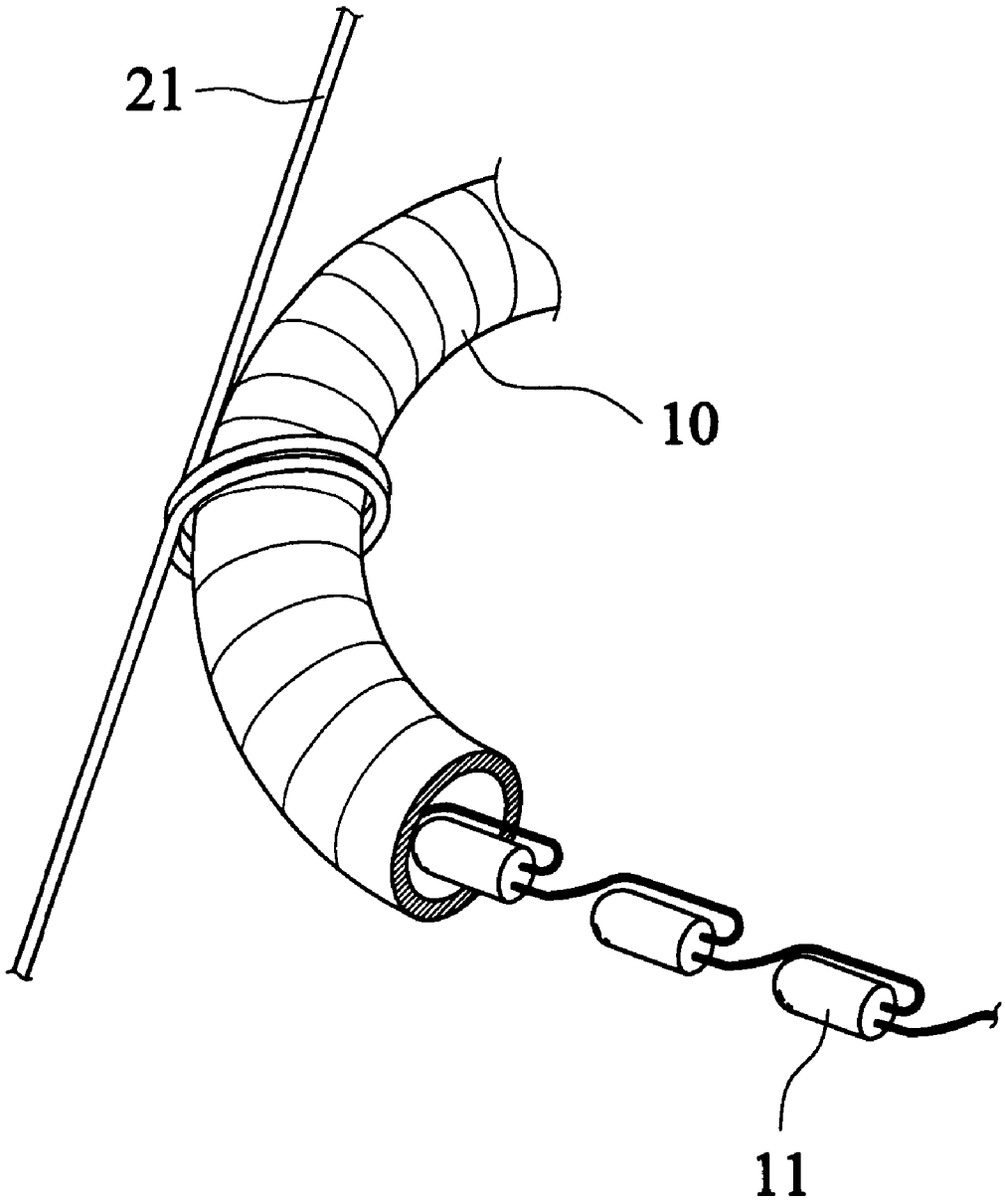
FIG. 4 is an enlarge view of a spiral decorative light tree showing the elongate pipe being bound by a rope.
Figure 5:
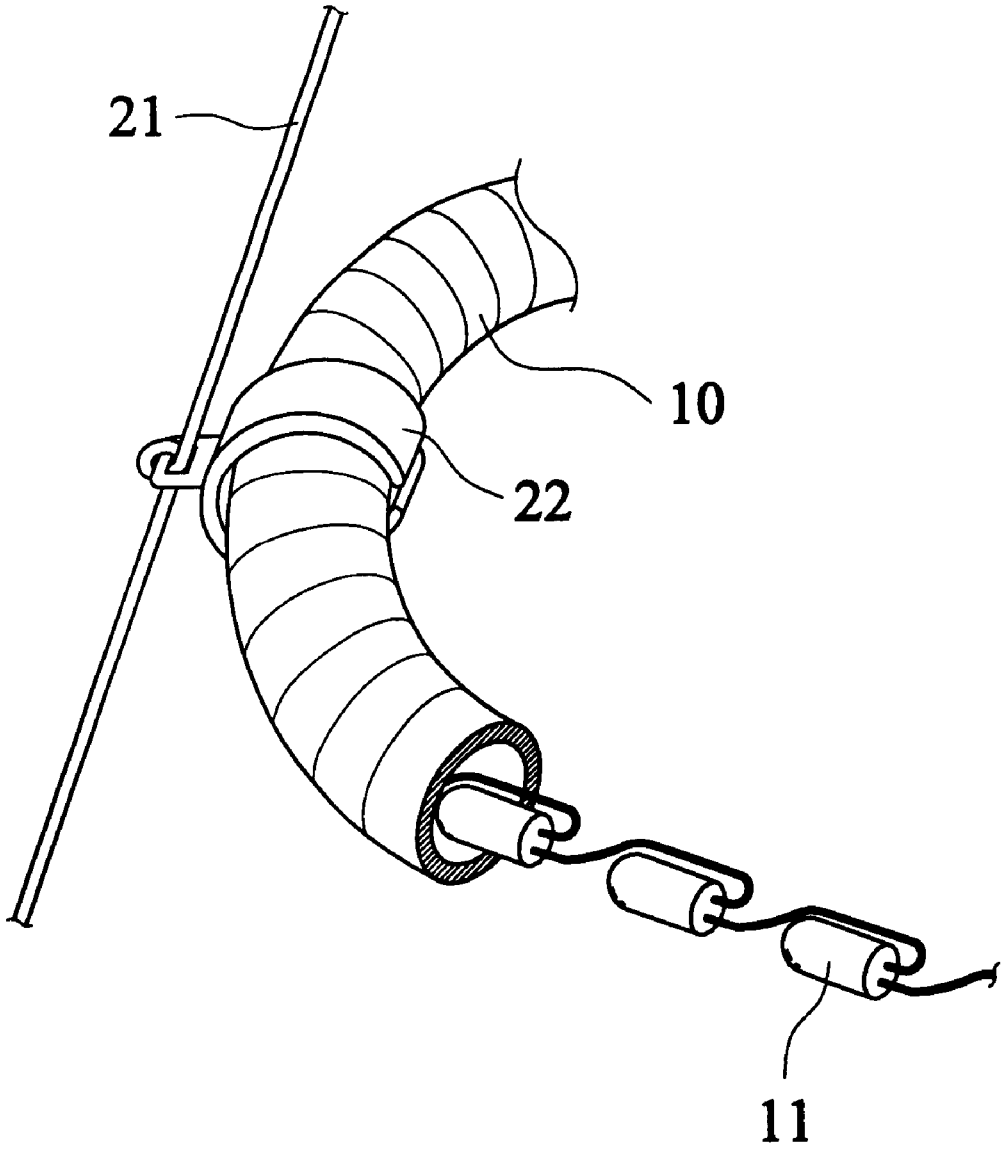
FIG. 5 is an enlarge view of a spiral decorative light tree showing the elongate pipe being bound by a rope incorporating with a clip.

The ropes 20 are made of plastic material, such as Nylon. A rope 21 may be bound directly on the elongate pipe 10, as shown in FIG. 4. Alternatively, a clip 22 may be used to clip on the elongate pipe 10 and then the rope 21 may be bound on the clip 22, as shown in FIG. 5.

Figure 6:
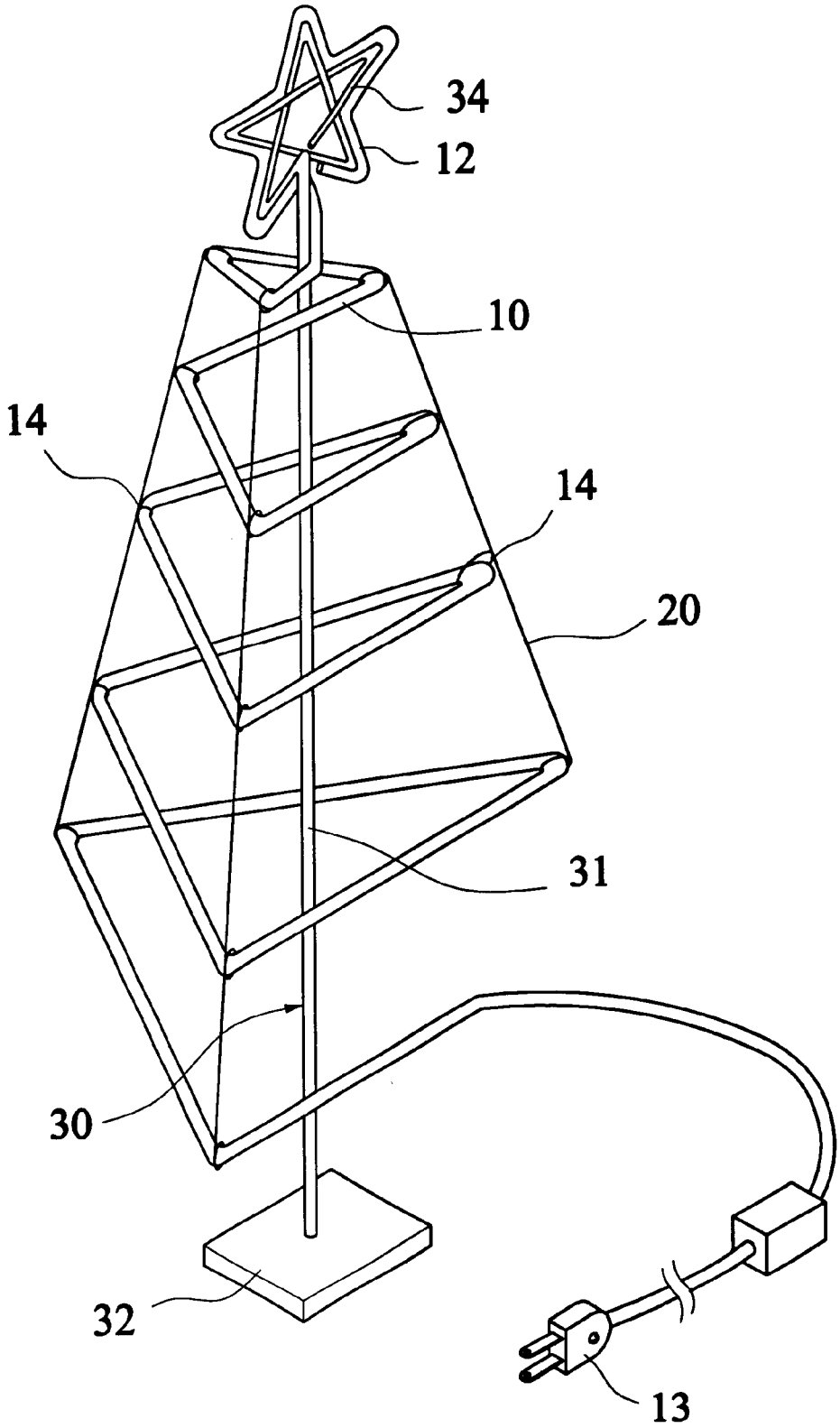
FIG. 6 is a perspective view of a spiral decorative light tree constructed in accordance with a third embodiment of the present invention.

With reference to FIG. 6, showing a decorative light tree constructed in accordance with a third embodiment of the present invention, comprising an elongate member 10, a number of ropes 20, and a supporting frame 30. The elongate member 10 is preferably made of soft and transparent material, such as rubber, with a hollow inner tube formed therein, comprising a plurality of straight sections and corners 14 where two straight sections meet. A star-shape surround section 12 is formed on a first end of the elongate member 10 and a free second end of the elongate pipe 10 coils sequentially to form a plane triangle spiral shape. A plurality of lighting members 11 are electrically connected in series and arranged inside the hollow inner tube of the elongate member 10 in a manner equally spaced from each other. A plug 13 is connected to the elongate member 10 for supplying electrical power thereto.

The supporting frame 30 comprises an upright central post 31 mounted on a stand 32. A star-shape member 34 is attached to the top end of the central post 31 for the star-shape surround section 12 of the elongate member 10 being mounted thereon. When spreading the elongate member 10 to arrange on the supporting frame 30, the star-shape surround section 12 is supported on the star-shape member 34 and the free second end is spirally suspended around the central post 31. The ropes 20 extend at a predetermined angle with respect to the central post 31 and angularly spaced from each other about the central post 31, binding on the corners 14 of the elongate member 10 thereby securely retaining the elongate member 10 in a three-dimensional spiral shape.

The ropes 20 are made of plastic material and bound directly on the elongate member 10. Alternatively, a number of clips may be used to clip on the elongate member 10 and then the ropes 20 may be bound on the clips.

Alternatively, the central post 31 may be formed with a tapering lower end for facilitating piercing into the ground when the spiral decorative light tree is used outdoor. At this time, each of the ropes 20 has a downward extended section for being fixed in a location by a fixing member.

A color material may be covered on the elongate member 10 separately, such as spreading transparent color paint or pasting transparent color paper on the elongate member 10. The series connected lighting members 11 locates separately in the location with color material or without color to make the spiral decorative light be more colorful.

Although the present invention has been described with respect to the preferred embodiments, it is contemplated that a variety of modifications, variations and substitutions may be done without departing from the scope of the present invention that is intended to be defined by the appended claims.

What is claimed is:

1. A decorative light tree comprising:

a) a central post having top and bottom ends with a supporting ring located adjacent to the top end;

b) a hollow, transparent, elongated pipe made of soft material, the pipe having a first end supported at the top end of the central post and a free second end, the pipe being arranged in a spiral around the central post;

c) a plurality of lighting members located completely within the pipe, the lighting members connected in series and being equally spaced from each other; and, d) a plurality of supporting ropes extending downwardly at an angle to the central post, the supporting ropes being circumferentially spaced apart around the supporting ring, each supporting rope engaged with each spiral of the elongated pipe so as to retain the elongated pipe in the spiral configuration.

2. The decorative light tree of claim 1 wherein the supporting ropes are made of plastic material.

3. The decorative light tree of claim 1 further comprising a plurality of clips engaged with the elongated pipe, each clip being engaged by one of the plurality of supporting ropes.

4. The decorative light tree of claim 1 further comprising a star-shaped member extending upwardly from the top end of the central post.

5. The decorative light tree of claim 4 further comprising a star-shaped section formed on the first end of the elongated pipe, the star-shaped section being mounted on the star-shaped member.

6. The decorative light tree of claim 1 further comprising a stand mounted on the bottom end of the central post.

7. The decorative light tree of claim 1 wherein the bottom end of the central post is tapered to facilitate insertion of the bottom end into a ground surface.

8. The decorative light tree of claim 7 wherein each of the supporting ropes has a downwardly extending section extending downwardly from a lowermost spiral portion of the elongated pipe.

9. A decorative light tree comprising:

a) a central post having top and bottom ends;

b) a hollow, transparent, elongated pipe made of soft material, the pipe having a first end supported at the top end of the central post and a free second end, the elongated pipe extending around the central post and having a plurality of interconnected straight sections each forming acute angles with adjacent straight sections with corners formed at junctions of adjacent straight sections;

c) a plurality of lighting members located completely within the elongated pipe, the lighting members connected in series and being equally spaced from each other; and, d) a plurality of supporting ropes extending downwardly at an angle to the central post and spaced apart from each other, each supporting rope engaging a plurality of corners.

10. The decorative light tree of claim 9 wherein the supporting ropes are made of plastic material.

11. The decorative light tree of claim 9 further comprising a plurality of clips engaged with the elongated pipe, each clip being engaged by one of the plurality of supporting ropes.

12. The decorative light tree of claim 9 further comprising a star-shaped member extending upwardly from the top end of the central post.

13. The decorative light tree of claim 12 further comprising a star-shaped section formed on the first end of the elongated pipe, the star-shaped section being mounted on the star-shaped member.

14. The decorative light tree of claim 9 further comprising a stand mounted on the bottom end of the central post.

15. The decorative light tree of claim 9 wherein the bottom end of the central post is tapered to facilitate insertion of the bottom end into a ground surface.

16. The decorative light tree of claim 15 wherein each of the supporting ropes has a downwardly extending section extending downwardly from a lower portion of the elongated pipe.

* * * * *